US005827635A

United States Patent [19]

Cole

[11] Patent Number: 5,827,635

[45] Date of Patent: Oct. 27, 1998

[54] HIGH TEMPERATURE COLOR DEVELOPMENT OF PHOTOGRAPHIC SILVER BROMOIODIDE COLOR NEGATIVE FILMS USING STABILIZED COLOR DEVELOPER SOLUTION

[75] Inventor: David Leroy Cole, Rochester, N.Y.

[73] Assignee: Eastman Kodak Company, Rochester, N.Y.

[21] Appl. No.: 916,559

[22] Filed: Aug. 22, 1997

Related U.S. Application Data

[60] Division of Ser. No. 703,593, Aug. 27, 1996, abandoned, which is a continuation-in-part of Ser. No. 590,241, Jan. 23, 1996, abandoned.

[51] Int. Cl.[6] ..... G03C 7/407

[52] U.S. Cl. ..... 430/372; 430/434; 430/486; 430/490

[58] Field of Search ..... 430/372, 434, 430/486, 490

[56] References Cited

U.S. PATENT DOCUMENTS

| | | | |
|---|---|---|---|
| 4,629,683 | 12/1986 | Itoh et al. | 430/390 |
| 4,798,783 | 1/1989 | Ishikawa et al. | 430/372 |
| 4,800,153 | 1/1989 | Morimoto et al. | 430/380 |
| 4,801,516 | 1/1989 | Ishikawa et al. | 430/380 |
| 4,814,260 | 3/1989 | Koboshi et al. | 430/464 |
| 4,833,068 | 5/1989 | Ohki et al. | 430/484 |
| 4,842,993 | 6/1989 | Yagihara et al. | 430/380 |
| 4,851,325 | 7/1989 | Morimoto et al. | 430/372 |
| 4,853,318 | 8/1989 | Fujita et al. | 430/380 |
| 4,876,174 | 10/1989 | Ishikawa et al. | 430/380 |
| 4,892,804 | 1/1990 | Vincent et al. | 430/380 |
| 4,897,339 | 1/1990 | Andoh et al. | 430/372 |
| 4,956,267 | 9/1990 | Ueda et al. | 430/372 |
| 4,963,475 | 10/1990 | Murai et al. | 430/467 |
| 4,965,176 | 10/1990 | Ishikawa | 430/378 |
| 4,966,834 | 10/1990 | Ishikawa et al. | 430/393 |
| 4,985,347 | 1/1991 | Fujimoto et al. | 430/393 |
| 5,028,517 | 7/1991 | Kuse et al. | 430/434 |
| 5,053,322 | 10/1991 | Shiba et al. | 430/464 |
| 5,066,571 | 11/1991 | Yoshida et al. | 430/489 |
| 5,071,734 | 12/1991 | Ueda et al. | 430/372 |
| 5,077,180 | 12/1991 | Yoshida et al. | 430/380 |
| 5,091,292 | 2/1992 | Fujimoto et al. | 430/467 |
| 5,093,226 | 3/1992 | Ohshima | 430/377 |
| 5,094,937 | 3/1992 | Morimoto | 430/485 |
| 5,100,765 | 3/1992 | Fujimoto | 430/434 |
| 5,110,713 | 5/1992 | Yoshida et al. | 430/372 |
| 5,110,985 | 5/1992 | Hayakawa et al. | 562/571 |
| 5,128,237 | 7/1992 | Kimura et al. | 430/378 |
| 5,147,766 | 9/1992 | Ishikawa et al. | 430/399 |
| 5,153,108 | 10/1992 | Ishikawa et al. | 430/376 |
| 5,153,111 | 10/1992 | Yoshida et al. | 430/444 |
| 5,173,394 | 12/1992 | Hayashi | 430/372 |
| 5,173,395 | 12/1992 | Asami | 430/376 |
| 5,178,992 | 1/1993 | Yoshida et al. | 430/372 |
| 5,202,229 | 4/1993 | Kuse et al. | 430/399 |
| 5,204,229 | 4/1993 | Nakamura et al. | 430/399 |
| 5,230,991 | 7/1993 | Nagaoka et al. | 430/393 |
| 5,236,814 | 8/1993 | Kuse et al. | 430/393 |
| 5,238,789 | 8/1993 | Ohshima | 430/372 |
| 5,246,819 | 9/1993 | Yoshida et al. | 430/386 |
| 5,248,811 | 9/1993 | Morimoto | 562/102 |
| 5,250,396 | 10/1993 | Ueda et al. | 562/357 |
| 5,252,439 | 10/1993 | Nakamura | 430/399 |
| 5,260,185 | 11/1993 | Takabayashi et al. | 430/491 |
| 5,262,563 | 11/1993 | Morimoto | 430/104 |
| 5,344,750 | 9/1994 | Fujimoto et al. | 430/434 |
| 5,354,646 | 10/1994 | Kobayashi et al. | 430/372 |
| 5,362,610 | 11/1994 | Yoshimoto | 430/465 |
| 5,376,509 | 12/1994 | Yoshimoto et al. | 430/449 |

FOREIGN PATENT DOCUMENTS

| | | |
|---|---|---|
| 269227 | 6/1988 | European Pat. Off. . |
| 434097 | 6/1991 | European Pat. Off. . |
| 468781 | 1/1992 | European Pat. Off. . |
| 488217 | 6/1992 | European Pat. Off. . |
| 488737 | 6/1992 | European Pat. Off. . |
| 530921 | 3/1993 | European Pat. Off. . |
| 540296 | 5/1993 | European Pat. Off. . |
| 556782 | 8/1993 | European Pat. Off. . |
| 574829 | 12/1993 | European Pat. Off. . |
| 611986 | 8/1994 | European Pat. Off. . |

OTHER PUBLICATIONS

JP 02–001846 (Abstract only).
JP 02–018556 (Abstract only).
JP 02–018557 (Abstract only).
JP 03–075745 (Abstract only).
JP 03–102344 (Abstract only).
JP 03–127058 (Abstract only).
JP 03–158849 (Abstract only).
JP 03–184044 (Abstract only).
JP 03–211547 (Abstract only).
JP 03–259145 (Abstract only).
JP 03–266837 (Abstract only).
JP 04–063342 (Abstract only).
JP 04–097355 (Abstract only).
JP 63–32548 (Abstract only).
JP 63–32549 (Abstract only).
JP 63–40149 (Abstract only).
JP 63–92949 (Abstract only).
JP 63–264751 (Abstract only).
JP 63–53551 (Abstract only).
JP 63–48548 (Abstract only).
JP 63–179351 (Abstract only).
JP 63–306444 (Abstract only).
JP 63–318557 (Abstract only).
JP 01–124851 (Abstract only).
JP 63–264752 (Abstract only).
JP 01–187548 (Abstract only).
JP 01–265250 (Abstract only).
JP 04–340961 (Abstract only).
JP 05–040333 (Abstract only).
JP 04–366949 (Abstract only).

*Primary Examiner*—Hoa Van Le
*Attorney, Agent, or Firm*—J. Lanny Tucker

[57] ABSTRACT

Silver bromoiodide color negative films can be rapidly color developed using heat stabilized color developing solutions kept at high temperatures with minimal changes in the resulting color record densities. These advantages are achieved using specific hydroxylamine derivatives as anti-oxidants in the color developer solution.

18 Claims, No Drawings

HIGH TEMPERATURE COLOR DEVELOPMENT OF PHOTOGRAPHIC SILVER BROMOIODIDE COLOR NEGATIVE FILMS USING STABILIZED COLOR DEVELOPER SOLUTION

RELATED APPLICATION

This is a Divisional Application of application Ser. No. 08/703,593, filed Aug. 27, 1996 which a Continuation-in-part Application of application Ser. No. 08/590,241, filed Jan. 23, 1996, both were abandoned.

FIELD OF THE INVENTION

The present invention relates to the processing of silver bromoiodide color negative films. In particular, it relates to color development of such films at high temperatures using heat stabilized color developer solutions having a specific hydroxylamine antioxidant.

BACKGROUND OF THE INVENTION

Production of photographic color images from light sensitive materials basically consists of two processes. First, color negative images are generated by light exposure of camera speed light sensitive films, which are sometimes called "originating" elements because the images are originated therein by the film user (that is, "picture taker"). These negative images are then used to generate positive images in light sensitive materials having a reflective base using a "printer". These latter materials are sometimes known as "display" elements and the resulting images may be known as "prints" or motion picture projection films.

The light sensitive materials are processed in several steps and processing solutions to provide the necessary images in automatic processing machines. Traditionally, this service has required one or two days for providing the customer with the desired prints. In recent years, customers have wanted faster service, and in some locations known as "mini-labs", it is desired to provide the customer with the desired prints within an hour. This requires the photoprocessing methods to be even faster, and reducing the processing time to within a few minutes is the ultimate desire in the industry.

Reduction in processing time of the "display" elements or color photographic papers has been facilitated by a number of recent innovations, including the use of predominantly silver chloride emulsions in the display elements.

Color negative films generally comprise little or no silver chloride in their emulsions, and generally have silver bromide as the predominant silver halide. More typically, the emulsions are silver bromoiodide emulsions with silver iodide levels up to several mol percent. Such films require these types of emulsions because emulsions containing high silver chloride have not demonstrated sufficient light sensitivity to be used as camera speed materials although they have the advantage of being rapidly processed without major changes to the color developer solution.

However, to shorten the processing time, specifically the color development time, of films containing silver bromoiodide emulsions, more active color developer solutions are needed. Various attempts have been made to increase color developer activity by increasing the pH, color developing agent concentration or temperature. However, when these changes are made, the stability of the solution often diminishes. For example, when the development temperature is increased from the conventional 37.8° C., and the color developer solution is held (or used) in the processing tanks for extended periods of times, silver bromoiodide elements processed with such solutions often exhibit unacceptably high density in the unexposed areas of the elements, that is unacceptably high Dmin.

Various methods have been proposed for stabilizing color developer solutions during use, but these methods are primarily used in processing high silver chloride emulsions. For example, color developers in U.S. Pat. No. 4,876,174 as being stabilized for processing high silver chloride by containing dialkylhydroxylamine antioxidants or preservatives. Other preservatives are also described in the art, such as hydrazines, hydroxamic acid and alpha-hydroxyketones, as described for example in U.S. Pat. No. 4,897,339 and U.S. Pat. No. 4,906,554. Another method for stabilization is to use an anionic surface active agent in combination with a substituted alkylhydroxylamine to process high silver chloride elements having a dry thickness of less than 15 $\mu$m, as described in U.S. Pat. No. 5,091,292. Still another method involves using a processor having a small surface ratio of the color developer so it has less contact with air.

All of the foregoing methods have been designed for processing high silver chloride photographic papers, and have not been shown to be effective in processing color negative silver bromoiodide films.

Attempts have also been made to stabilize color developing solutions prior to their use, by storing them in sealed containers having low permeability to oxygen, as described in U.S. Pat. No. 4,814,260. Components that produce gases in the solutions are removed or replaced by non-gas producing components. Other storage containers have been designed from multilayers of various polymeric materials to reduce oxygen transmittance. However, these attempts fail to provide stability when the color developer solutions are being held for long periods of time at high temperature in the processing machine, especially when development is carried out at high temperature.

There remains a need for a process for rapid color development of silver bromoiodide films using color developer solutions stabilized for high temperature keeping.

SUMMARY OF THE INVENTION

The problems described above have been overcome with a method of photoprocessing comprising:

A) color developing an imagewise exposed color negative photographic film element containing at least one silver bromoiodide emulsion, with a color developer solution that comprises:

a color developing agent present at from about 0.01 to about 0.1 mol/l, and an antioxidant present at from about 0.001 to about 0.5 mol/l, the antioxidant having the formula:

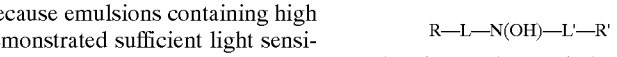

R—L—N(OH)—L'—R' wherein L and L' are independently alkylene of 1 to 8 carbon atoms or alkylenephenylene of 1 to 3 carbon atoms in the alkylene portion, and R and R' are independently hydrogen, carboxy, sulfo or phosphono, provided that at least one of R and R' is not hydrogen, the contacting being carried out at from about 45 to about 65° C. for from about 20 to about 150 seconds, provided that the photographic film element exhibits a ΔDmin of less than 10% when processed with the color developer solution that has been held at 57.5° C. for up to 320 hours prior to processing.

This invention also provides a method for stabilizing a color developer solution comprising:

mixing a color developing agent present at from bout 0.01 to about 0.1 mol/l, with an antioxidant present at from about 0.001 to about 0.5 mol/l, the antioxidant having the formula:

R—L—N(OH)—L'—R' wherein L and L' are independently alkylene of 1 to 8 carbon atoms or alkylenephenylene of 1 to 3 carbon atoms in the alkylene portion, and R and R' are independently hydrogen, carboxy, sulfo or phosphono, provided that at least one of R and R' is not hydrogen, provided that when the color developer solution is held at 57.5° C. for up to 320 hours, and is then used to process a color photographic film having at least one color record comprising a silver bromoiodide emulsion having associated therewith a color forming coupler, the ΔDmin of the three color records will be less than 10% when the largest change in any color record is positive (that is, increasing Dmin) or less than 5% when the largest change in any color record is negative (that is, decreasing Dmin), wherein ΔDmin is defined as:

$$\Delta D\text{min} = \frac{(1\%\ Cr + 1\%\ Cg + 1\%\ Cb)}{3}$$

$$\%\ C_i = \left[ \frac{D\text{min}_i(t) - D\text{min}_i(0)}{D\text{min}_i(0)} \right] \times 100$$

"i" is r (red), g (green), or b (blue) and "t" is time.

The method of this invention allows for rapid color development of camera ready film elements containing a silver bromoiodide emulsion. The color developer solutions are remarkably stable even when maintained and/or used at relatively high temperatures, that is, above 45° C. for lengthy periods of time. This eat stability is obtained by including in the color developer solutions a specific hydroxylamine derivative. While there are my hydroxylamines known as useful antioxidants in color developer solutions, it has been unexpectedly found that the combination of photographic elements having silver bromoiodide emulsions and color developer solutions containing the specific hydroxylamine derivatives described herein minimizes unacceptable increase in Dmin when the color developer solutions are kept and used at high processing temperatures for extended periods of time.

The ΔDmin increase in the color records of the elements is kept at 10% or less when such color developer solutions are maintained and/or used at elevated temperatures, such as 57.5° C. for up to 320 hours.

DETAILED DESCRIPTION OF THE INVENTION

The antioxidants useful in the practice are represented by the formula:

R—L—N(OH)—L'—R' wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene and sec-butylene), or substituted or unsubstituted alkylenephenylene of 1 to 3 carbon atoms in the alkylene portion (such as benzylene, dimethylenephenylene, and isopropylenephenylene).

The alkylene and alkylenephenylene groups can also be substituted with up to 4 substituents that do not interfere with the stabilizing effect of the molecule, or the solubility of the compound in the color developer solution. Such substituents must be compatible with the color developer components and must not negatively impact the photographic processing system. Such substituents include but are not limited to, alkyl of 1 to 6 carbon atoms, fluoroalkyl groups of 1 to 6 carbon atoms, alkoxy of 1 to 6 carbon atoms, phenyl, hydroxy, halo, phenoxy, alkylthio of 1 to 6 carbon atoms, acyl groups, cyano, or amino.

In the noted formula, R and R' are independently hydrogen, carboxy, sulfo, phosphono, or other acid groups, provided that at least one of R and R' is not hydrogen. Salts of the acid groups are considered equivalents in this invention. Thus, the free acid forms of the hydroxylamines can be used, as well as the organic or inorganic salts of the acids, such as the alkali metal, pyridinium, tetraethylammonium, tetramethylammonium and ammonium salts. The sodium and potassium salts are the preferred salts. In addition, readily hydrolyzable ester equivalents can also be used, such as the methyl and ethyl esters of the acids. When L or L' is alkylenephenylene, the carboxy, sulfo or phosphono group is preferably at the para position of the phenylene, but can be at other positions if desired. More than one carboxy, sulfo or phosphono group can be attached to the phenylene radical.

Preferably, one or both of R and R' are hydrogen, carboxy or sulfo, with hydrogen and sulfo (or salts or readily hydrolyzable esters thereof) being more preferred. Most preferably, R is hydrogen and R' is sulfo (or a salt thereof).

Preferably, L and L' are independently substituted or unsubstituted alkylene of 3 to 6 carbon atoms -(such as n-propyl, isopropyl, n-butyl, sec-butyl, t-butyl, n-pentyl, 1-methylpentyl and 2-ethylbutyl), or substituted or unsubstituted alkylenephenylene having 1 or 2 carbon atoms in the alkylene portion (such as benzyl, and dimethylenephenyl).

More preferably, at least one, and optionally both, of L and L' is a substituted or unsubstituted alkylene group of 3 to 6 carbon atoms that is branched at the carbon atom directly attached (that is, covalently bonded) to the nitrogen atom of the hydroxylamine molecule. Such branched divalent groups include, but are not limited to, isopropylene, sec-butylene, t-butylene, sec-pentylene, t-pentylene, sec-hexylene and t-hexylene. Isopropylene is most preferred.

In one embodiment, L and L' are the same. In other and preferred embodiments, they are different. In the latter embodiment, L is more preferably a branched alkylene as described above, and L' is a linear alkylene of 1 to 6 carbon atoms (such as methylene, ethylene, n-propylene, n-butylene, n-pentylene and n-hexylene).

Representative hydroxylamine derivatives useful in the practice of this invention include, but are not limited to, N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl) hydroxylamine, N-methyl-N-(p-carboxyl-m-methylbenzyl) hydroxylamine, N-isopropyl-N-(p-sulfobenzyl) hydroxylamine, N-ethyl-N-(p-phosphonobenzyl) hydroxylamine, N-isopropyl-N-(2-carboxymethylene-3-propionic acid)hydroxylamine, and alkali metal salts thereof. The first compound and the sodium or potassium salts thereof are most preferred.

The hydroxylamine derivatives described herein as useful antioxidants can be readily prepared using published procedures, such as those described in U.S. Pat. No. 3,287,125, U.S. Pat. No. 3,778,464, U.S. Pat. No. 5,110,985 and U.S. Pat. No. 5,262,563, all incorporated herein by reference for the synthetic methods. One general synthetic procedure for preparing sulfo-substituted hydroxylamines derivatives comprises reacting an N-alkylhydroxylamine with a vinylsulfonate in a suitable solvent (such as water, an alcohol, tetrahydrofuran or methyl ethyl ketone). For the alkali metal salts of vinylsulfonates, water is the best solvent. In cases where the hydroxylammonium salt is available, an equivalent of a base must be used to liberate the free N-alkylhydroxylamine. Commercial sources of free N-alkylhydroxylamines and N-alkylhydroxylammonium salts include Angus Chemicals and Aldrich Chemical Company. Further details of this procedure would be readily apparent to one skilled in the art.

To prepare the compounds having alkylenephenylene groups, a mono-substituted hydroxylamine can be reacted with α-halo-toluic acids (or equivalent substituted α-halo-toluic acids), as further described in copending and commonly assigned U.S.S.N. 08/448,075 filed May 23, 1995, by Marrese et al as a Continuation of U.S.S.N. 08/257,601 on Jun. 9, 1994, now abandoned.

An alternative synthetic preparation method comprises reacting a vinylic compound having the structure

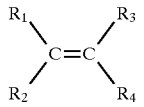

with a hydroxylamine having the structure HO—$NHR_5$, wherein $R_1$ and $R_2$ are independently hydrogen or an alkyl group, $R_3$ is hydrogen, halo or an alkyl group, and $R_4$ is sulfo, —$COOR_7$ wherein $R_7$ is hydrogen or an alkyl group of 1 to 4 carbon atoms, or phosphono. $R_5$ is hydrogen, an

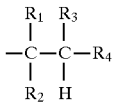

alkyl group of 1 to 12 carbon atoms or, the reacting step taking place in water or a water-miscible organic solvent, or mixture thereof, in the absence of a neutralizing base.

Useful solvents for this reaction include lower alcohols (such as methanol, ethanol or isopropanol) or other water-miscible solvents (such as N-methyl pyrrolidone, tetrahydrofuran, N, N-dimethylacetamide, N, N-dimethylformamide or dimethylsulfoxide), or mixtures of any of these solvents (with or without water). The reaction temperature can be from about 0 to about 100° C., and will take generally at least two hours. The reaction mixture can have any desirable pH less than about 10.

Specific preparations of preferred compounds are described below prior to the Examples for illustrative purposes. The compounds for which a synthesis is not described can be similarly prepared using routine modifications that would be readily apparent to one skilled in the art.

The antioxidant described herein is included in the color developer solution in an amount of at least about 0.001 mol/l, and in a preferred amount of from about 0.001 to about 0.5 mol/l. A most preferred amount is from about 0.005 to about 0.5 mol/l. More than one antioxidant can be used in the same color developer solution if desired, but preferably, only one is used.

The pH of the color developer solution is generally from about 9 to about 12 (preferably from about 10 to about 11), as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates.

The color developer solutions include one or more color developing agents, of which there are hundreds of possibilities. Useful classes of such materials include, but are not limited to, aminophenols, p-phenylenediamines (especially N,N-dialkyl-p-phenylenediamines) and others that are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Generally, the amount of color developing agent is from about 0.01 to about 0.1 mol/l, with from about 0.02 to about 0.06 mol/l being preferred.

The color developer solution can be easily prepared by mixing a suitable color developing agent (in a suitable solution) with an antioxidant as described above (in a suitable aqueous solution). Water can be added to the resulting solution to provide the desired concentrations of an aqueous solution, and the pH can be adjusted as noted above.

The solution can also include one or more of a variety of other addenda which are commonly used in such compositions, such as alkali metal halides (such as potassium chloride, potassium bromide, sodium bromide and sodium iodide), metal sequestering agents (such as polycarboxylic or aminopolycarboxylic acids or polyphosphonates), buffers (as noted above), other preservatives (such as sulfites and alcoholamines), antifoggants, development accelerators, optical brighteners, wetting agents, stain reducing agents, surfactants, defoaming agents, and water-soluble or water-dispersible color couplers, as would be readily understood by one skilled in the art (see for example, *Research Disclosure,* noted above and U.S. Pat. No. 4,814,260 of Koboshi et al). The amounts of such additives are well known in the art also. For example, the amounts of halides can be varied widely, but are generally at least about $5\times10^{-5}$ to about 0.4 mol/l for bromide ion and at least about $5\times10^{-7}$ and up to about 0.01 mol/l for iodide ion. A preferred color developing composition is described below in Example 1. The color developing solution may or may not contain chloride ion because chloride ion essentially has no effect on the efficacy of the color developer composition. Thus, generally, chloride ion is not added or present, but if it is, it is not detrimental to the invention. It is more important that some bromide and iodide ions be present in the color developer solution.

While other known preservatives such as sulfites or alcohol amines (such as triethandamine) can be present, the color developer solution contains no hydroxylamine or hydroxylamine derivatives besides those described above.

The color developing solution is preferably formulated and used as an aqueous solution, either as the working developer solution or as a replenishing solution. However, as is known in the art, they can also be formulated and used as dry tablets. The technology for this is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

The color developing solution has obvious utility to provide color development of an imagewise exposed color photographic negative image forming film element comprising a support and one or more silver halide emulsion layers (or color records) containing an imagewise distribution of developable silver halide emulsion grains, and having one or more color forming couplers associated therewith. A wide variety of types of photographic films containing various types of emulsions can be processed using the present invention, the types of elements being well known in the art (see *Research Disclosure,* noted above). The color developer solution can also be used in the processing of color reversal films having one or more color records.

The present invention is particularly useful for processing camera speed negative photographic films containing silver bromoiodide emulsions. Generally, the iodide content of such silver halide emulsions is less than about 40 mol % (based on total silver), preferably from about 0.05 to about 10 mol %, and more preferably, from about 0.5 to about 6 mol %. The emulsions can be of any crystal morphology (such as cubic, octahedral, cubooctahedral or tabular as are known in the art), or irregular morphology (such as multiple twinning or rounded). Preferably, the elements have at least two separate light sensitive emulsion layers, and each layer contains a silver bromoiodide emulsion as defined above.

Such elements generally have a camera speed defined as an ISO speed of at least 25, and preferably an ISO speed of at least 50.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27-1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

The layers of the photographic elements can have any useful binder material or vehicle known in the art, including various types of gelatins and other colloidal materials (or mixtures thereof). One useful binder material is acid processed gelatin that can be present in any layer in any suitable amount.

The elements are typically exposed to suitable radiation to form a latent image and then processed to form a visible dye image. Processing includes the step of color development in the presence of a color developing agent (typically in a color developer) to reduce developable silver halide and to oxidize the color developing agent. Oxidized color developing agent in turn reacts with a color-forming coupler to yield a dye. Silver in the element can then be removed using conventional bleaching and fixing solutions.

Development is carried out by contacting the element under suitable time and temperature conditions, in suitable processing equipment, to produce the desired developed image. Additional processing steps can then be carried out using conventional procedures, including but not limited to, one or more development stop, bleaching, fixing, washing (or rinsing), stabilizing and drying steps, in any particular desired order as would be known in the art for either color negative or color reversal processing methods. Useful processing steps, conditions and materials useful therefor are well known (see for example, *Research Disclosure*).

The photographic elements processed in the practice of this invention can be single or multilayer color elements. Multilayer color elements typically contain dye image-forming units (or color records) sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerable details of the element structure and components, and suitable methods of processing various types of elements are described in *Research. Disclosure,* noted above. Included within such teachings in the art is the use of various classes of cyan, yellow and magenta color couplers which can be used with the present invention. In particular, the present invention can be used to process photographic elements containing pyrazolotriazole magenta dye forming couplers.

Representative color negative films that can be processed using the present invention include, but are not limited to, KODAK ROYAL GOLD® films, KODAK GOLD® PLUS 100 film, KODAK GOLD® SUPER 200 film, KODAK GOLD ULTRA 400 film, FUJI SUPER G Plus films, FUJI SMARTFILM™ products, KONICA VX films, KONICA SRG3200 film, 3M SCOTCH® ATG films, and AGFA HDC and XRS films.

Processing according to the present invention can be carried out using conventional deep tanks holding processing solutions or automatic processing machines. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

The length of time and temperatures used for each processing step of the present invention, other than color development, can be any desired condition, whether conventional or not.

The color developer solutions described herein are stable when stored and/or used at the elevated temperatures described herein for extended periods of time, for example up to 300 hours. Typically, such temperatures are encountered during rapid photoprocessing methods where the silver bromoiodide films described above are color developed after imagewise exposure.

For color development, the processing temperature is generally from about 45° to about 65° C., preferably from about 50° to about 65° C., and more preferably from about 50° to about 60° C. Most preferably, the development temperature is from about 55 to about 60° C.

The time for color development is from about 20 to about 150 seconds, with a time of from about 30 to about 120 seconds being preferred, and a time of from about 30 to about 90 seconds being more preferred. The overall processing time (from development to final rinse or wash) can be from about 50 seconds to about 40 minutes. Shorter overall processing times, that is, less than about 3 minutes, are desired for processing photographic color negative films according to this invention.

A preferred embodiment of this invention is a method of photoprocessing comprising:

A) color developing an imagewise exposed color negative photographic film element containing a red-sensitive emulsion layer, a green-sensitive emulsion layer and a blue-sensitive emulsion layer, each emulsion layer comprising a silver bromoiodide emulsion comprising from about 0.5 to about 10 mol % iodide based on total silver, with a color developer solution that comprises:

a color developing agent present at from about 0.01 to about 0.1 mol/l, and an antioxidant present at from about 0.001 to about 0.5 mol/l, the antioxidant having the formula:

R—L—N(OH)—L'—R' wherein L and L' are independently alkylene of 3 to 5 carbon atoms, at least one of L and L' being an alkylene that is branched at the carbon atom attached to the nitrogen atom, and R and R' are independently hydrogen, carboxy or sulfo, provided that at least one of R and R' is not hydrogen, the color developing being carried out at from about 50 to about 60° C. for from about 30 to about 90 seconds, provided that the photographic film element exhibits a ΔDmin of less than 10% when processed with the color developer solution that has been held at 57.5° C. for up to 320 hours prior to processing, B) bleaching the color developed element, C) fixing the bleached element, and D) washing or rinsing the fixed element.

The following synthetic preparations and examples are provided to illustrate preparation of several preferred hydroxylamines, as well as the practice of this invention and not to limit it in any way. Unless otherwise indicated, percentages are by weight.

Preparation of N-isopropyl-N-(2-ethanesulfonic acid) hydroxylamine

Isopropyl hydroxylamine (330 g of 15% in water, 0.665 mol) was combined with sodium vinylsulfonate (350 g of 25% in water, 0.665. mol) and sodium hydroxide (0.4 g, 0.01 mol). The resulting solution was refluxed for four hours, after which no starting materials were detected by thin layer chromatography. The reaction mixture was cooled to room temperature and precipitated into eight liters of stirred isopropanol. The resulting white solid was dried in a vacuum oven prior to use. $^1$HNMR (δ, ppm)2.9–3.1 (br,$CH_2CH_2$, 4H), 2.85 (septet, i-Pr, 1H), 0.95(d, i-Pr, 6H) confirmed the structure, and ion chromatography revealed no chloride ion and 1.2% sulfate.

Preparation of N-isopropyl-N-(2-ethanesulfonic acid)hydroxylamine, Sodium Salt An aqueous solution (420 ml) of vinylsulfonic acid, sodium salt (25%) was heated to reflux. While at reflux, an aqueous solution (480 g) of isopropyl hydroxylamine was linearly added over a period of two hours. During the next five hours, water (600 g) was removed linearly by distillation. After cooling the reaction solution to 20° C., isopropanol (500 ml) was added with good mechanical stirring to keep the resulting white solid suspended. This solid was collected on a sintered glass funnel, rinsed with additional fresh isopropanol (100 ml), and dried overnight at 50° C. under vacuum for analysis. N-isopropyl-N-(2-ethanesulfonic acid)-hydroxylamine, sodium salt was isolated as a white powder. However, the product could have been left in the reaction solution for later use if desired.

All analyses were consistent with the structure of the desired compound. The $^1$H NMR in $D_2O$ had peaks at 4.8(NOH), 3.2–2.9(isopropyl methine and two methylenes of the ethylsulfonato sodium salt moiety), and 1.1 ppm (two methyls of the isopropyl group). The $^{13}$C NMR had peaks at 59.4, 52.4, 49.9 and 19.2 ppm. The sodium analysis was 11.5%.

Preparation of Bis(2-ethanesulfonic acid) hydroxylamine, Disodium Salt

An aqueous solution (150 ml) of vinylsulfonic acid, sodium salt (25%) was heated to 70° C. over a period of 30 minutes. While the solution was stirred, an aqueous solution (10.3 g) of hydroxylamine (50%) was linearly added over a period of 5 minutes. The reaction solution was held at 70° C. for eight hours, then cooled to 20° C. over a period of 30 minutes. To the reaction solution was then added methanol (800 ml) over a period of 5 minutes. After an additional 30 minutes, the resulting solid product was collected on a filter funnel, rinsed with fresh methanol (100 ml), and dried overnight at 50° C. under vacuum to give 49 g of white solid for analysis.

The analyses were consistent with the structure of the desired product. The $^1$H NMR in $D_2O$ had peaks at 4.8 (NOH), and 4.7 and 3.2 ppm for the two different methylene protons in the molecule. The $^{13}$C NMR had peaks at 56.4 and 49.8 ppm for the methylene carbons in the molecule. The sodium analysis was 15.1% (consistent for the monohydrate).

Preparation of N-isopropyl-N-(3-propionic Acid) hydroxylamine

Acrylic acid (120 g) was added to an aqueous solution (825 g) of isopropylhydroxylamine (15%) and methanol (1250 ml) at room temperature with vigorous mechanical stirring. Upon completion of the addition, the reaction solution was heated to 60° C. and maintained at that temperature overnight. Upon cooling to room temperature and concentration of the reaction solution by evaporation, a yellow oil crystallized upon standing. Isopropanol and ether were added to facilitate collection of the resulting product by suction filtration for analysis. The resulting white granular solid was dried overnight under vacuum to give 155 g.

The analyses were consistent with the desired structure. The $^1$H NMR in dimethylsulfoxide-d6 had peaks at 7.0 (NOH), 2.7(isopropyl methine plus methylene group of-the propionic acid moiety), 2.35(methylene of propionic acid moiety), and 0.9 ppm(two methyls of the isopropyl group). The mass spectrum was consistent with the desired compound.

Preparation of Bis-N-(2-carboxyethyl) hydroxylamine, Dimethylester

Methanol (200 ml) was added to a mechanically stirred aqueous solution of hydroxylamine (13.24 g of 50%. solution, 0.2 moles). Methyl acrylate (34.44 ml, 0.4 moles) was added dropwise to the solution at 25° C. over thirty minutes as the solution became warm during the resulting reaction. After completion of the addition, the reaction mixture was heated to 60° C. in an oil bath and stirred overnight. The pH of the resulting mixture was 6.15. The solution was then cooled to room temperature, and concentrated at 40° C. under reduced pressure to yield a pale yellow, cloudy oil (41.6 g, 99%).

All analyses of the oil were consistent with the desired structure. The $^1$H NMR spectrum in dimethylsulfoxide-d6 had peaks at 7.9 (NOH), 3.54 (s,6H), 2.75 (t,4H), and 2.45 (t,4H).

Preparation of Bis-N-(2-Carboxyethyl) hydroxylamine, Diethylester

Methanol (200 ml) was added to a mechanically stirred aqueous solution of hydroxylamine (13.24 g of 50% solution, 0.2 moles). Ethyl acrylate (43.34 ml, 0.4 moles) was added dropwise to the solution at 25° C. over thirty minutes as the solution became warm during the resulting reaction. After completion of the addition, the reaction mixture was heated to 60° C. in an oilbath and stirred overnight. The pH of the resulting mixture was 6.5. The solution was then cooled to room temperature, and concentrated at 40° C. under reduced pressure to yield a pale yellow, cloudy oil (46.3 g, 99%).

All analyses of the oil were consistent with the desired structure. The $^1$H NMR spectrum in dimethylsulfoxide-d6 had peaks at 7.9 (NOH), 4.0 (q,4H), 2.75 (t,4H), 2.40 (t,4H), and 1.1 (t,6H).

Preparation of N-(2-carboxyethyl)-N-hydroxy-β-Alanine

Methanol (200 ml) was added to a mechanically stirred aqueous solution of hydroxylamine (13.24 g of 50% solution, 0.2 moles). Acrylic acid (27.4 ml, 0.4 moles) was added dropwise to the solution at 25° C. over thirty minutes. After a few hours of reaction, a white precipitate began to form. The reaction mixture was stirred overnight at room temperature, and the resulting white solid was filtered out, washed with cold water, and dried in vacuum overnight to give 30.4 g (85%) of the desired compound.

All analyses of the solid were consistent with the desired structure. The $^1$H NMR spectrum in dimethylsulfoxide-d6 had peaks at 5.0 (br.s), 2.7 (t,4H) and 2.35 (t,4H), and a melting point of 148°–149° C.

Preparation of N-isopropyl-N-(2-carboxymethylene-3-propionic acid)-hydroxylamine Methanol (300 ml) was added to an aqueous 15% solution (400 ml) of N-isopropylhydroxylamine (0.8 moles), followed by addition of itaconic acid (104 g, 0.8 moles) in portions as a solid. Additional methanol (100 ml) was used to rinse the itaconic acid into the flask. After all of the solid acid had dissolved, the mixture was stirred at room temperature for 6 days, and filtered to collect the resulting white solid product. This material was dried under mild vacuum to a weight of 142 g (m.p. 136°–8° C.). NMR analysis was consistent with the structure of the desired compound.

Similarly, bis(2-carboxymethylene-3-propionic acid) hydroxylamine was prepared using similar conditions and slightly varying solvent mixtures of water and methanol, water and tetrahydrofuran or tetrahydrofuran and N,N-dimethylformamide. This compound was prepared by reacting itaconic acid with hydroxylamine.

Materials and Methods for the Examples

The following stock color developer solution was used in the following Comparative and Invention Examples:

| | |
|---|---|
| Potassium carbonate, anhydrous | 34.3 g |
| Potassium bicarbonate | 2.32 g |
| Sodium sulfite, anhydrous | 0.38 g |
| Sodium metabisulfite | 2.78 g |
| Potassium iodide | 1.2 mg |
| Sodium bromide | 1.3 g |
| Diethylenetriaminepentaacetic acid, pentasodium salt | 3.37 g |
| Hydroxylamine antioxidant | 2.41 g |
| Ethanol,2-[(4-amino-3-methyl-phenyl)ethylamino]sulfate (1:1) salt | 4.52 g |
| Water to make 1 liter (pH adjusted to 10.0) | |

The following examples show the magnitude of changes in the minimum (Dmin) and maximum (Dmax) density regions in each color record of samples of imagewise exposed, processed commercially available KODAK GOLD ULTRA™ 400 speed color negative film as a function of the color developer age, temperature and antioxidant. The film samples used in Comparative Example 1 were developed at the standard temperature of 37.8° C. for 3 minutes and 15 seconds using the commercially known KODAK C-41 RA processing method (including development, bleaching, fixing and rinsing). All other examples were developed for 45 seconds at 57.5° C. (unless otherwise noted).

The percent density changes for each color record (identified as "%Cr" for red record, "%Cg" for green record, and "%Cb" for blue record) were calculated as:

$$\% C_{Dmin}=\{[\mathrm{Dmin}(t)-\mathrm{Dmin}(\mathbf{0})]/\mathrm{Dmin}(\mathbf{0})\}\times 100, \text{ or}$$

$$\% C_{Dmax}=\{[\mathrm{Dmax}(t)-\mathrm{Dmax}(\mathbf{0})]/\mathrm{Dmax}(\mathbf{0})\}\times 100.$$

wherein Dmin(t) and Dmax(t) are the densities at time "t" after the experiments have begun, and Dmin(0) and Dmax (0) are the densities at the start of the experiments. By color records is meant the red-, green- and blue-sensitive units in the film samples, each unit having one or more emulsion layers having the desired light sensitivity.

COMPARATIVE EXAMPLE 1

In this experiment, which is representative of the commercial C-41 Process, the color developer solution contained hydroxylamine sulfate as the antioxidant. Tables I and II show the results of density changes in each color record of the processed film samples for given "aging" times (time at 37.8° C.) of color developer solution.

TABLE I

| Time (Hours) | Dmin Red Record | Dmin Green Record | Dmin Blue Record | % Cr | % Cg | % Cb |
|---|---|---|---|---|---|---|
| 0 | 0.257 | 0.695 | 0.951 | 0.00 | 0.00 | 0.00 |
| 48 | 0.260 | 0.669 | 0.955 | 1.17 | 0.58 | 0.42 |
| 120 | 0.261 | 0.701 | 0.957 | 1.56 | 0.86 | 0.63 |
| 168 | 0.260 | 0.701 | 0.954 | 1.17 | 0.86 | 0.32 |
| 196 | 0.252 | 0.697 | 0.952 | −1.29 | 0.29 | 0.11 |
| 223 | 0.256 | 0.699 | 0.955 | −0.39 | 0.58 | 0.42 |
| 288 | 0.258 | 0.702 | 0.952 | 0.39 | 1.01 | 0.11 |

TABLE II

| Time (Hours) | Dmax Red Record | Dmax Green Record | Dmax Blue Record | % Cr | % Cg | % Cb |
|---|---|---|---|---|---|---|
| 0 | 1.18 | 1.71 | 1.97 | 0.00 | 0.00 | 0.00 |
| 48 | 1.18 | 1.69 | 1.94 | 0.00 | −1.17 | −1.52 |
| 120 | 1.19 | 1.70 | 1.95 | 0.85 | −0.58 | −1.02 |
| 168 | 1.18 | 1.69 | 1.91 | 0.00 | −1.17 | −3.05 |
| 196 | 1.15 | 1.67 | 1.88 | −2.54 | −2.34 | −4.57 |
| 223 | 1.17 | 1.68 | 1.89 | −0.85 | −1.75 | −4.06 |
| 288 | 1.15 | 1.65 | 1.86 | −2.54 | −3.51 | −5.58 |

The data in Tables I and II show that the standard C-41 Process conditions do not produce large changes in any of the color record densities. The largest positive change in Dmin is about 1% as represented by the change in the green record after aging the color developer for 288 hours. The Dmax in all three color records decreased as the color developer was aged, with the largest change being seen in the blue record at 288 hours. The loss of Dmax reflects a loss in color developer activity as a function of color developer solution hold time and is most probably due to the oxidation of the color developing agent by oxygen as the sulfite and hydroxylamine sulfate stabilizing agents are lost to oxidation.

COMPARATIVE EXAMPLE 2

This experiment used the same processing solution compositions as in Comparative Example 1 except that the processing solutions were aged at 57.5° C. for extended periods of time. The changes in densities in the color records are shown in Tables III and IV below.

TABLE III

| Time (Hours) | Dmin Red Record | Dmin Green Record | Dmin Blue Record | % Cr | % Cg | % Cb |
|---|---|---|---|---|---|---|
| 0 | 0.304 | 0.735 | 1.042 | 0.00 | 0.00 | 0.00 |
| 24 | 0.294 | 0.751 | 1.044 | −3.29 | −1.90 | 0.19 |
| 96 | 0.321 | 0.760 | 1.107 | 5.59 | 3.40 | 6.24 |
| 120 | 0.318 | 0.758 | 1.110 | 4.61 | 3.13 | 6.53 |
| 144 | 0.332 | 0.768 | 1.133 | 9.21 | 4.49 | 8.73 |
| 168 | 0.338 | 0.766 | 1.141 | 11.18 | 4.22 | 9.50 |
| 264 | 0.393 | 0.816 | 1.226 | 29.28 | 11.02 | 17.66 |
| 312 | 0.389 | 0.808 | 1.227 | 27.96 | 9.93 | 17.75 |

TABLE IV

| Time (Hours) | Dmax Red Record | Dmax Green Record | Dmax Blue Record | % Cr | % Cg | % Cb |
|---|---|---|---|---|---|---|
| 0 | 1.36 | 2.52 | 3.37 | 0.00 | 0.00 | 0.00 |
| 24 | 1.37 | 2.52 | 3.38 | 0.74 | 0.00 | 0.30 |
| 96 | 1.40 | 2.59 | 3.46 | 2.94 | 2.78 | 2.67 |
| 120 | 1.39 | 2.59 | 3.47 | 2.21 | 2.78 | 2.97 |
| 144 | 1.42 | 2.63 | 3.54 | 4.41 | 4.37 | 5.04 |
| 168 | 1.36 | 2.58 | 3.48 | 0.00 | 2.38 | 3.26 |
| 264 | 1.28 | 2.62 | 3.54 | −5.88 | 3.97 | 5.04 |
| 312 | 1.26 | 2.61 | 3.53 | −7.35 | 3.57 | 4.75 |

It is apparent that after being aged at the higher temperature, the color developer solution loses stability and produces undesirable density increases in Dmin all color records. These changes are as high as 29% in the red record after the color developer solution had been used at the high temperature for 264 hours. The changes in Dmax of the three color records were about the same as those observed in Comparative Example 1.

COMPARATIVE EXAMPLE 3

In this experiment, no hydroxylamine was included in the color developer. Thus, the color developer was the same as in Comparative Example 1 with the omission of a hydroxylamine derivative antioxidant. Aging of the solution and color development were carried out as in Comparative Example 2, that is, at 57.5° C. The changes in densities in the color records are shown in Tables V and VI below.

TABLE V

| Time (Hours) | Dmin Red Record | Dmin Green Record | Dmin Blue Record | % Cr | % Cg | % Cb |
|---|---|---|---|---|---|---|
| 0 | 0.283 | 0.724 | 0.988 | 0.00 | 0.00 | 0.00 |
| 24 | 0.282 | 0.716 | 0.996 | −0.35 | −1.10 | −0.81 |
| 96 | 0.275 | 0.716 | 0.985 | −2.83 | −1.10 | −0.30 |
| 120 | 0.265 | 0.703 | 0.979 | −6.36 | −2.90 | −0.91 |
| 144 | 0.269 | 0.695 | 0.984 | −4.95 | −4.01 | −0.40 |
| 168 | 0.265 | 0.701 | 0.983 | −6.36 | −3.18 | −0.51 |
| 264 | 0.253 | 0.686 | 0.977 | −10.60 | −5.25 | −1.11 |
| 312 | 0.251 | 0.684 | 0.970 | −11.31 | −5.25 | −1.82 |

TABLE VI

| Time (Hours) | Dmax Red Record | Dmax Green Record | Dmax Blue Record | % Cr | % Cg | % Cb |
|---|---|---|---|---|---|---|
| 0 | 1.34 | 2.49 | 3.24 | 0.00 | 0.00 | 0.00 |
| 24 | 1.31 | 2.46 | 3.16 | −2.24 | −1.20 | −2.47 |
| 96 | 1.18 | 2.31 | 2.89 | −11.94 | −7.23 | −10.80 |
| 120 | 1.17 | 2.29 | 2.86 | −12.69 | −8.03 | −11.73 |
| 144 | 1.17 | 2.29 | 2.88 | −12.69 | −8.03 | −11.73 |
| 168 | 1.12 | 2.25 | 2.83 | −16.42 | −9.64 | −12.96 |
| 264 | 0.99 | 2.13 | 2.68 | −26.12 | −14.46 | −17.28 |
| 312 | 0.88 | 1.93 | 2.45 | −34.33 | −22.49 | −24.38 |

The data show that when the hydroxylamine antioxidant is omitted, no increase in Dmin is seen as a function of time. In fact, the Dmin and Dmax of all three records decreased, consistent with the oxidative loss of the color developing agent. This Comparative Example illustrates the need to stabilize the color developing agent.

INVENTION EXAMPLE 1

In this example of the invention, N-isopropyl-N-(2-ethanesulfonic acid)hydroxylamine (0.026 mol/l was used as the antioxidant in the color developer instead of hydroxylamine sulfate. Aging and processing were carried out as described for Comparative Example 2. The results are shown in Tables VII and VIII below.

TABLE VII

| Time (Hours) | Dmin Red Record | Dmin Green Record | Dmin Blue Record | % Cr | % Cg | % Cb |
|---|---|---|---|---|---|---|
| 0 | 0.259 | 0.664 | 0.979 | 0.00 | 0.00 | 0.00 |
| 24 | 0.252 | 0.668 | 0.971 | −2.70 | 0.60 | −0.82 |
| 48 | 0.254 | 0.676 | 0.968 | −1.93 | 1.81 | −1.12 |
| 120 | 0.262 | 0.686 | 0.983 | 1.16 | 3.31 | 0.41 |
| 144 | 0.262 | 0.696 | 0.981 | 1.16 | 4.82 | 0.20 |
| 192 | 0.266 | 0.704 | 0.989 | 2.70 | 6.02 | 1.02 |
| 216 | 0.260 | 0.695 | 0.987 | 0.39 | 4.67 | 0.82 |

TABLE VII-continued

| Time (Hours) | Dmin Red Record | Dmin Green Record | Dmin Blue Record | % Cr | % Cg | % Cb |
|---|---|---|---|---|---|---|
| 312 | 0.273 | 0.700 | 0.994 | 5.41 | 5.42 | 1.53 |
| 360 | 0.265 | 0.700 | 0.990 | 2.32 | 5.42 | 1.12 |
| 456 | 0.262 | 0.697 | 0.986 | 1.16 | 4.97 | 0.72 |

TABLE VIII

| Time (Hours) | Dmax Red Record | Dmax Green Record | Dmax Blue Record | % Cr | % Cg | % Cb |
|---|---|---|---|---|---|---|
| 0 | 1.05 | 2.04 | 2.62 | 0.00 | 0.00 | 0.00 |
| 24 | 1.03 | 2.02 | 2.59 | −1.90 | −0.98 | −1.15 |
| 48 | 1.04 | 2.03 | 2.58 | −0.95 | −0.49 | −1.53 |
| 120 | 1.04 | 2.02 | 2.54 | −0.95 | −0.98 | −3.05 |
| 144 | 1.08 | 2.07 | 2.61 | 2.86 | 1.47 | −0.38 |
| 192 | 1.08 | 2.07 | 2.58 | 2.86 | 1.47 | −1.53 |
| 216 | 1.06 | 2.04 | 2.55 | 0.95 | 0.00 | −2.67 |
| 312 | 1.11 | 2.11 | 2.66 | 5.71 | 3.43 | 1.53 |
| 360 | 1.12 | 2.14 | 2.69 | 6.67 | 4.90 | 2.67 |
| 456 | 1.09 | 2.14 | 2.68 | 3.81 | 4.90 | 2.29 |

The results in Table VII show that the change in Dmin as a function of time is much improved relative to Comparative Example 2, in all color records. The small changes in Dmax as a function of time, as shown in Table VIII, demonstrate the stability of the color developer solution used in this invention.

INVENTION EXAMPLE 2

This example is like Invention Example 1 except that N,N-bis(propionic acid)hydroxylamine (0.029 mol/l) was used as the color developer antioxidant, and the concentration of sodium bromide was increased to 0.051 mol/l. Aging and processing were carried out like Comparative Example 2. The results of the changes in color record densities are shown in Tables IX and X below.

TABLE IX

| Time (Hours) | Dmin Red Record | Dmin Green Record | Dmin Blue Record | % Cr | % Cg | % Cb |
|---|---|---|---|---|---|---|
| 0 | 0.247 | 0.682 | 0.953 | 0.00 | 0.00 | 0.00 |
| 24 | 0.257 | 0.692 | 0.958 | 4.05 | 1.47 | 0.52 |
| 48 | 0.247 | 0.681 | 0.954 | 0.00 | −0.15 | 0.10 |
| 72 | 0.247 | 0.690 | 0.958 | 0.00 | 1.17 | 0.52 |
| 144 | 0.240 | 0.676 | 0.949 | −2.83 | −0.88 | −0.42 |
| 168 | 0.237 | 0.695 | 0.962 | −4.05 | 1.91 | 0.94 |
| 192 | 0.233 | 0.682 | 0.957 | −5.67 | 0.00 | 0.42 |
| 240 | 0.235 | 0.706 | 0.972 | −4.86 | 3.52 | 1.99 |
| 312 | 0.243 | 0.727 | 0.989 | −1.62 | 6.60 | 3.78 |

TABLE X

| Time (Hours) | Dmax Red Record | Dmax Green Record | Dmax Blue Record | % Cr | % Cg | % Cb |
|---|---|---|---|---|---|---|
| 0 | 1.25 | 2.37 | 3.02 | 0.00 | 0.00 | 0.00 |
| 24 | 1.26 | 2.41 | 3.11 | 0.80 | 1.69 | 2.98 |
| 48 | 1.28 | 2.40 | 3.01 | 2.40 | 1.27 | −0.33 |
| 72 | 1.28 | 2.41 | 3.04 | 2.40 | 1.69 | 0.66 |
| 144 | 1.25 | 2.39 | 3.06 | 0.00 | 0.84 | 1.32 |

TABLE X-continued

| Time (Hours) | Dmax Red Record | Dmax Green Record | Dmax Blue Record | % Cr | % Cg | % Cb |
|---|---|---|---|---|---|---|
| 168 | 1.19 | 2.44 | 3.08 | −4.80 | 2.95 | 1.99 |
| 192 | 1.17 | 2.45 | 3.12 | −6.40 | 3.38 | 3.31 |
| 240 | 1.14 | 2.46 | 3.12 | −8.80 | 3.80 | 3.31 |
| 312 | 1.14 | 2.57 | 3.19 | −8.80 | 8.44 | 5.63 |

The results in Table IX are much improved relative to Comparative Example 2 in all color records. There was no increase in Dmin as the color developer solution was aged and only a small loss of Dmax was observed over time.

COMPARATIVE EXAMPLE 4

In this example, which is outside the scope of this invention, N-isopropyl-N-propionamide hydroxylamine (0.029 mol/l) was used in place of hydroxylamine sulfate in the color developer solution, and sodium bromide was increased to 0.051 mol/l. Aging and processing were carried out in the same manner as Comparative Example 2. The results are shown in Tables XI and XII below.

TABLE XI

| Time (Hours) | Dmin Red Record | Dmin Green Record | Dmin Blue Record | % Cr | % Cg | % Cb |
|---|---|---|---|---|---|---|
| 0 | 0.298 | 0.688 | 0.944 | 0.00 | 0.00 | 0.00 |
| 48 | 0.268 | 0.669 | 0.949 | −10.07 | −2.76 | 0.53 |
| 72 | 0.257 | 0.659 | 0.942 | −13.76 | −4.22 | −0.21 |
| 144 | 0.246 | 0.668 | 0.946 | −17.45 | −2.91 | 0.21 |
| 168 | 0.243 | 0.684 | 0.954 | −18.46 | −0.58 | 1.06 |
| 192 | 0.234 | 0.684 | 0.955 | −21.48 | −0.58 | 1.17 |
| 216 | 0.231 | 0.687 | 0.955 | −22.48 | −0.15 | 1.17 |
| 240 | 0.235 | 0.691 | 0.965 | −21.14 | 0.44 | 2.22 |
| 312 | 0.228 | 0.707 | 0.983 | −23.49 | 2.76 | 4.13 |

TABLE XII

| Time (Hours) | Dmax Red Record | Dmax Green Record | Dmax Blue Record | % Cr | % Cg | % Cb |
|---|---|---|---|---|---|---|
| 0 | 1.31 | 2.48 | 3.10 | 0.00 | 0.00 | 0.00 |
| 48 | 1.31 | 2.43 | 3.04 | 0.00 | −2.02 | −1.94 |
| 72 | 1.28 | 2.40 | 3.03 | −2.29 | −3.23 | −2.26 |
| 144 | 1.24 | 2.37 | 2.99 | −5.34 | −4.44 | −3.55 |
| 168 | 1.20 | 2.46 | 3.12 | −8.40 | −0.81 | 0.65 |
| 192 | 1.15 | 2.43 | 3.06 | −12.21 | −2.02 | −1.29 |
| 216 | 1.11 | 2.45 | 3.04 | −15.27 | −1.21 | −1.94 |
| 240 | 1.15 | 2.45 | 3.07 | −12.21 | −1.21 | −0.97 |
| 312 | 1.05 | 2.43 | 2.99 | −19.85 | −2.02 | −3.55 |

It is apparent from these results that the hydroxylamine derivative failed to prevent large changes in both Dmin and Dmax, especially in the red color record, as the color developer solution was aged. The direction and magnitude of the changes would suggest that the hydroxylamine derivative was not functioning as an effective antioxidant in this instance.

COMPARATIVE EXAMPLE 5

In this experiment, N,N-bis(propionamide) hydroxylamine (0.029 mol/l) was used as the antioxidant in the color developer solution, and the sodium bromide concentration was increased to 0.051 mol/l. Processing was conducted as described in Comparative Example 2. The resulting density changes are shown in Tables XIII and XIV below.

TABLE XIII

| Time (Hours) | Dmin Red Record | Dmin Green Record | Dmin Blue Record | % Cr | % Cg | % Cb |
|---|---|---|---|---|---|---|
| 0 | 0.354 | 0.705 | 0.978 | 0.00 | 0.00 | 0.00 |
| 24 | 0.360 | 0.731 | 0.992 | 1.69 | 3.69 | 1.43 |
| 48 | 0.351 | 0.716 | 0.984 | −0.85 | 1.56 | 0.61 |
| 72 | 0.335 | 0.728 | 0.985 | −5.37 | 3.26 | 0.72 |
| 144 | 0.263 | 0.690 | 0.959 | −25.71 | −2.13 | −1.94 |
| 168 | 0.244 | 0.698 | 0.962 | −31.07 | −0.99 | −1.64 |
| 192 | 0.238 | 0.688 | 0.962 | −32.77 | −2.41 | −1.64 |
| 216 | 0.255 | 0.698 | 0.976 | −27.97 | −0.99 | −0.20 |
| 240 | 0.233 | 0.705 | 0.969 | −34.18 | 0.00 | −0.92 |
| 312 | 0.241 | 0.726 | 0.989 | −31.92 | 2.98 | 1.12 |

TABLE XIV

| Time (Hours) | Dmax Red Record | Dmax Green Record | Dmax Blue Record | % Cr | % Cg | % Cb |
|---|---|---|---|---|---|---|
| 0 | 1.31 | 2.46 | 3.05 | 0.00 | 0.00 | 0.00 |
| 24 | 1.31 | 2.49 | 3.05 | 0.00 | 1.22 | 0.00 |
| 48 | 1.41 | 2.58 | 3.28 | 7.63 | 4.88 | 7.54 |
| 72 | 1.35 | 2.54 | 3.19 | 3.05 | 3.25 | 4.59 |
| 144 | 1.27 | 2.44 | 3.11 | −3.05 | −0.81 | 1.97 |
| 168 | 1.17 | 2.42 | 3.06 | −10.69 | −1.63 | 0.33 |
| 192 | 1.14 | 2.43 | 3.11 | −12.98 | −1.22 | 1.97 |
| 216 | 1.15 | 2.51 | 3.18 | −12.21 | 2.03 | 4.26 |
| 240 | 1.11 | 2.42 | 3.04 | −15.27 | −1.63 | −0.33 |
| 312 | 1.15 | 2.58 | 3.24 | −12.21 | 4.88 | 6.23 |

The results show that the stability of the color developer solution is similar to that of Comparative Example 4.

COMPARATIVE EXAMPLE 6

This example was used to demonstrate the temperature dependence of the Dmin increase of the conventional C-41 color developer solution when it is "aged" for extended periods of time at 50° C. Processing was conducted as described in Comparative Example 2. The results are shown in Tables XV and XVI.

TABLE XV

| Time (Hours) | Dmin Red Record | Dmin Green Record | Dmin Blue Record | % Cr | % Cg | % Cb |
|---|---|---|---|---|---|---|
| 0 | 0.260 | 0.672 | 0.951 | 0.00 | 0.00 | 0.00 |
| 24 | 0.253 | 0.693 | 0.954 | −2.69 | 3.12 | 0.32 |
| 96 | 0.266 | 0.699 | 0.964 | 2.31 | 4.02 | 1.37 |
| 120 | 0.264 | 0.685 | 0.965 | 1.54 | 1.93 | 1.47 |
| 144 | 0.261 | 0.695 | 0.974 | 0.38 | 3.42 | 2.42 |
| 264 | 0.274 | 0.699 | 0.988 | 5.38 | 4.02 | 3.89 |
| 336 | 0.277 | 0.711 | 1.014 | 6.54 | 5.80 | 6.62 |
| 432 | 0.285 | 0.713 | 1.040 | 9.62 | 6.10 | 9.36 |

TABLE XVI

| Time (Hours) | Dmax Red Record | Dmax Green Record | Dmax Blue Record | % Cr | % Cg | % Cb |
|---|---|---|---|---|---|---|
| 0 | 1.04 | 2.05 | 2.58 | 0.00 | 0.00 | 0.00 |
| 24 | 1.02 | 2.07 | 2.60 | −1.92 | 0.98 | 0.78 |

TABLE XVI-continued

| Time (Hours) | Dmax Red Record | Dmax Green Record | Dmax Blue Record | % Cr | % Cg | % Cb |
|---|---|---|---|---|---|---|
| 96 | 1.13 | 2.16 | 2.71 | 8.65 | 5.37 | 5.04 |
| 120 | 1.12 | 2.13 | 2.68 | 7.69 | 3.90 | 3.88 |
| 144 | 1.12 | 2.14 | 2.71 | 7.69 | 4.39 | 5.04 |
| 264 | 1.14 | 2.16 | 2.70 | 9.62 | 5.37 | 4.65 |
| 336 | 1.12 | 2.09 | 2.65 | 7.69 | 1.95 | 2.71 |
| 432 | 1.06 | 2.07 | 2.63 | 1.92 | 0.98 | 1.94 |

The data in Table XV show that the higher processing temperature produced undesirable Dmin increases in all color records. The changes are not as large as when the processing was at 57.5° C., but they are still too significant and are present in all color records. The changes in the Dmax for all color records are of the same magnitude as those observed in the standard C-41 process.

INVENTION EXAMPLE 3

In this example, N-isopropyl-N-(2-ethanesulfonic acid) hydroxylamine (0.026 mol/l) was used as the antioxidant in the color developer solution. It was aged at 50° C., and processing was like Comparative Example 2. The density changes in the color records are shown in Tables XVII and XVIII below.

TABLE XVII

| Time (Hours) | Dmin Red Record | Dmin Green Record | Dmin Blue Record | % Cr | % Cg | % Cb |
|---|---|---|---|---|---|---|
| 0 | 0.277 | 0.698 | 0.966 | 0.00 | 0.00 | 0.00 |
| 24 | 0.273 | 0.721 | 0.973 | −1.44 | 3.30 | 0.72 |
| 96 | 0.271 | 0.707 | 0.974 | −2.17 | 1.29 | 0.83 |
| 120 | 0.274 | 0.717 | 0.975 | −1.08 | 2.72 | 0.93 |
| 144 | 0.278 | 0.727 | 0.984 | 0.36 | 4.15 | 1.86 |
| 264 | 0.281 | 0.715 | 0.987 | 1.44 | 2.44 | 2.17 |
| 336 | 0.284 | 0.727 | 0.990 | 2.53 | 4.15 | 2.48 |
| 432 | 0.287 | 0.714 | 0.993 | 3.61 | 2.29 | 2.80 |

TABLE XVIII

| Time (Hours) | Dmax Red Record | Dmax Green Record | Dmax Blue Record | % Cr | % Cg | % Cb |
|---|---|---|---|---|---|---|
| 0 | 1.30 | 2.37 | 2.95 | 0.00 | 0.00 | 0.00 |
| 24 | 1.23 | 2.32 | 2.85 | −5.38 | −2.11 | −3.39 |
| 96 | 1.24 | 2.28 | 2.86 | −4.62 | −3.80 | −3.05 |
| 120 | 1.26 | 2.32 | 2.89 | −3.08 | −2.11 | −2.03 |
| 144 | 1.28 | 2.34 | 2.90 | −1.54 | −1.27 | −1.69 |
| 264 | 1.31 | 2.35 | 3.00 | 0.77 | −0.84 | 0.00 |
| 336 | 1.34 | 2.39 | 2.96 | 3.08 | 0.84 | 0.34 |
| 432 | 1.32 | 2.51 | 3.14 | 1.54 | 5.91 | 6.44 |

The results in Table XVII show that the changes in Dmin as a function of time are much improved relative to Comparative Example 6. The small changes in Dmax, as shown in Table XVIII, demonstrate the stability of the color developer solution.

COMPARATIVE EXAMPLE 7

In this experiment, conventional N,N-diethylhydroxylamine (0.029 mol/l) was used as the antioxidant in the color developer solution, and the sodium bromide concentration was increased to 0.051 mol/l. Aging and processing were conducted as described in Comparative Example 2. The density changes in the color records are shown in Tables XIX and XX below.

TABLE XIX

| Time (Hours) | Dmin Red Record | Dmin Green Record | Dmin Blue Record | % Cr | % Cg | % Cb |
|---|---|---|---|---|---|---|
| 0 | 0.255 | 0.668 | 0.953 | 0.00 | 0.00 | 0.00 |
| 72 | 0.330 | 0.776 | 1.023 | 29.41 | 16.17 | 7.35 |
| 120 | 0.318 | 0.757 | 1.022 | 24.71 | 13.32 | 7.24 |
| 264 | 0.306 | 0.737 | 1.028 | 20.00 | 10.33 | 7.87 |
| 408 | 0.281 | 0.714 | 1.015 | 10.20 | 6.89 | 6.51 |

TABLE XX

| Time (Hours) | Dmax Red Record | Dmax Green Record | Dmax Blue Record | % Cr | % Cg | % Cb |
|---|---|---|---|---|---|---|
| 0 | 1.16 | 2.11 | 2.70 | 0.00 | 0.00 | 0.00 |
| 72 | 1.41 | 2.43 | 3.15 | 21.55 | 15.17 | 16.67 |
| 120 | 1.36 | 2.35 | 3.04 | 17.24 | 11.37 | 12.59 |
| 264 | 1.26 | 2.29 | 2.99 | 8.62 | 8.53 | 10.74 |
| 408 | 1.07 | 2.22 | 2.92 | −7.76 | 5.21 | 8.15 |

The results show an unacceptable Dmin increase in the three color records after three days of "aging" of the color developer. The Dmin increases decreases thereafter, but remains unacceptably high. The Dmax changes in the same manner as the Dmin.

The invention has been described in detail with particular reference to preferred embodiments thereof, but it will be understood that variations and modifications can be effected within the spirit and scope of the invention.

I claim:

1. A method of photoprocessing comprising:

A) color developing an imagewise exposed color negative photographic film element containing at least one silver bromoiodide emulsion, with a color developer solution that comprises:

a color developing agent present at from about 0.01 to about 0.1 mol/l, and an antioxidant present at from about 0.001 to about 0.5 mol/l, said antioxidant having the formula:

R—L—N(OH)—L'—R' wherein L and L' are independently alkylene of 1 to 8 carbon atoms or alkylenephenylene of 1 to 3 carbon atoms in the alkylene portion, and R and R' are independently hydrogen, carboxy, sulfo or phosphono, provided that at least one of R and R' is not hydrogen, said contacting being carried out at from about 45° to about 65° C. for from about 20 to about 150 seconds, provided that said photographic film element exhibits a ΔDmin of less than 10% when processed with said color developer solution that has been held at 57.5° C. for up to 320 hours prior to processing, wherein ΔDmin is defined as:

$$\Delta D\text{min} = (1\%\ Cr + 1\%\ Cg + 1\%\ Cb)/3$$

$$\%\ C_i = \left[\frac{D\text{min}_i(t) - D\text{min}_i(0)}{D\text{min}_i(0)}\right] \times 100$$

"i" is r (red), g (green), or b (blue), and "t" is time.

2. The method of claim 1 wherein said silver bromoiodide emulsion comprises from about 0.05 to about 10 mol % iodide based on total silver.

3. The method of claim 1 wherein said photographic film element comprises at least two separate light sensitive emulsion layers, and each layer comprises a silver bromoiodide emulsion.

4. The method of claim 1 wherein said contacting is carried out at from about 50° to about 65° C. for from about 30 to about 120 seconds.

5. The method of claim 4 wherein said contacting is carried out at from about 55° to about 60° C. for from about 30 to about 90 seconds.

6. The method of claim 1 wherein said antioxidant is present in an amount of from about 0.005 to about 0.5 mol/l.

7. The method of claim 1 wherein L and L' are independently alkylene of 3 to 6 carbon atoms, or alkylenephenylene having 1 or 2 carbon atoms in the alkylene portion.

8. The method of claim 1 wherein L and L' are the same.

9. The method of claim 8 wherein L and L' are independently alkylene of 3 to 6 carbon atoms that are branched at the carbon atom directly attached to the nitrogen atom.

10. The method of claim 8 wherein L is alkylene branched at the carbon atom directly attached to the nitrogen atom, and L' is a linear alkylene.

11. The method of claim 1 wherein R and R' are independently hydrogen, carboxy or sulfo.

12. The method of claim 1 wherein R and R' are independently hydrogen or sulfo.

13. The method of claim 1 wherein said antioxidant is N-isopropyl-N-(2-ethanesulfonic acid)hydroxylamine, N,N-bis(propionic acid)hydroxylamine, N,N-bis(2-ethanesulfonic acid)hydroxylamine, N-isopropyl-N-(n-propylsulfonic acid)hydroxylamine, N-2-ethanephosphonic acid-N-(propionic acid)hydroxylamine, N,N-bis(2-ethanephosphonic acid)hydroxylamine, N-sec-butyl-N-(2-ethanesulfonic acid)hydroxylamine, N,N-bis(sec-butylcarboxylic acid)hydroxylamine, N-methyl-N-(p-carboxylbenzyl)hydroxylamine, N-isopropyl-N-(p-carboxylbenzyl)hydroxylamine, N,N-bis(p-carboxylbenzyl) hydroxylamine, N-methyl-N-(p-carboxyl-m-methylbenzyl) hydroxylamine, N-isopropyl-N-(p-sulfobenzyl) hydroxylamine, N-ethyl-N-(p-phosphonobenzyl) hydroxylamine, N-isopropyl-N-(2-carboxymethylene-3-propionic acid)hydroxylamine, or an alkali metal salt thereof.

14. The method of claim 1 wherein said color developer solution has a pH of from about 10 to about 11.

15. The method of claim 1 wherein said color developer solution further comprises bromide ion in a concentration of at least about $5\times10^{-5}$ mol/l.

16. The method of claim 1 wherein said color developer solution comprises iodide ions in a concentration of at least about $5\times10^{-7}$ mol/l.

17. A method of photoprocessing comprising:

A) color developing an imagewise exposed color negative photographic film element containing a red-sensitive emulsion layer, a green-sensitive emulsion layer and a blue-sensitive emulsion layer, each emulsion layer comprising a silver bromoiodide emulsion comprising from about 0.5 to about 10 mol % iodide based on total silver, with a color developer solution comprising:

a color developing agent present at from about 0.01 to about 0.1 mol/l, and an antioxidant present at from about 0.001 to about 0.5 mol/l, said antioxidant having the formula:

R—L—N(OH)—L'—R' wherein L and L' are independently alkylene of 3 to 5 carbon atoms, at least one of L and L' being an alkylene that is branched at the carbon atom attached to the nitrogen atom, and R and R' are independently hydrogen, carboxy or sulfo, provided that at least one of R and R' is not hydrogen, said color developing being carried out at from about 50° to about 60° C. for from about 30 to about 90 seconds, provided that said photographic film element exhibits a ΔDmin of less than 10% when processed with said color developer solution that has been held at 57.5° C. for up to 320 hours prior to processing, B) bleaching said color developed element, C) fixing said bleached element, and D) washing or rinsing said fixed element.

18. The method of claim 17 wherein said color developer solution has a pH of from about 10 to about 11, and comprises bromide ions in a concentration of from about $5\times10^{-5}$ to about 0.4 mol/l, and iodide ions in a concentration of from about $5\times10^{-7}$ to about 0.01 mol/l.

* * * * *